US005355687A

United States Patent [19]

Carpenter et al.

[11] Patent Number: 5,355,687

[45] Date of Patent: Oct. 18, 1994

[54] PAN COOLER AND METHOD

[75] Inventors: Donald Carpenter; Craig Kushen, both of Gardena, Calif.

[73] Assignee: Kairak, Inc., Gardena, Calif.

[21] Appl. No.: 47,791

[22] Filed: Apr. 15, 1993

[51] Int. Cl.[5] ..... F25D 23/12

[52] U.S. Cl. ..... 62/258; 62/446

[58] Field of Search ..... 62/288, 258, 382, 443, 62/446; 165/168

[56] References Cited

U.S. PATENT DOCUMENTS

| | | | |
|---|---|---|---|
| 1,912,577 | 6/1933 | Glass | 62/446 X |
| 2,360,074 | 10/1944 | Robison | 62/446 |
| 2,797,560 | 7/1957 | Kooiker et al. | 62/288 |
| 2,890,863 | 6/1959 | Scal | 62/382 X |
| 2,893,805 | 7/1959 | Ferguson | 62/382 X |
| 3,971,231 | 7/1976 | Derry | 62/446 X |
| 5,117,649 | 6/1992 | Mangini et al. | 62/258 X |

*Primary Examiner*—William E. Tapolcai
*Attorney, Agent, or Firm*—John J. Connors

[57] ABSTRACT

Disclosed is a pan cooler for a refrigeration unit which has a plurality of pans 22 which hold food removably mounted in the refrigeration unit. There is an opening 20 in the top wall 18 of the unit's cabinet 12 designed to enable the pans to be seated in the opening. Location means seat an individual pan 22 in one of a plurality of predetermined pan positions in the opening, and an individual pan, when in a predetermined pan position, is seated in the opening 20 so that substantially the entire lower body of the pan is disposed within the cooling chamber 16 of cabinet 12. The location means allows an individual pan 22 to be removed from the opening 20 and then reseated in the opening. A plurality of cooling elements 54 are disposed at the opening 20 in close proximity to the pan positions and mounted so that substantially the entire cooling element is disposed within the cooling chamber 16.

18 Claims, 7 Drawing Sheets

PAN COOLER AND METHOD

BACKGROUND OF THE INVENTION

1. Field of the Invention

This invention relates to a refrigeration unit used in the food service industry to cool open pans holding food that are removably located in the top of the unit. The present invention employs a uniquely configured cooling element located in close proximity to the pans and mounted so that substantially the entire cooling element is disposed within the cooling chamber of the refrigeration unit.

2. Background Discussion

In the food service industry, it is conventional to use a large refrigeration unit that has an opening or openings in its top wall that provide a place to hold pans of food in the cooling chamber of the unit. The refrigeration unit serves as a work station in a commercial kitchen, and its top wall is about waist high, providing a generally flat, planar work surface. The pans are removed as required for refilling and cleaning, their individual, lower body portions are enclosed within the refrigeration unit when the pans are placed in the opening in the top wall.

The pans are open on top so that users may remove food from the pans while the pans are seated in the opening. Typically, the pans have a volumetric capacity ranging between about 50 and about 800 cubic inches, with a depth ranging from about 4 to about 6 inches, a width from about 3 to about 12 inches, and a length from about 6 to about 12 inches. The pans are made of metal, usually stainless steel, and can be of various configurations such as, for example, rectangular and box-like, cylindrical, bowl-like, etc. They are conveniently handled by one person and are dropped into the opening. The pans typically have an outwardly extending ledge that engages the lip of the opening and a support structure or bars extending across the opening. Thus, the body of the pan is within the cooling chamber of the refrigeration unit, and the food in the pan is, at least theoretically, maintained cool.

Typically, the opening in the top wall is elongated, allowing several pans to be stacked in a row, side by side, within the opening. For example, a unitary and rectangular opening is employed when rectangular and box-like pans are used. Alternately, a series of circular openings arranged side by side in the top wall of the refrigeration unit would be employed when cylindrical or bowl-like pans are used. Because of this close stacking of the pans, the cool air within the refrigeration unit does not always come into intimate contact with the sides of the pan, and the food within the pan tends to warm up, especially food near the central section of the pan. This may lead to the growth of bacteria within the food, particularly if the food remains in the pan for a substantial period of time. It is believed that this unsafe way of storing food may have led to serious illness in some individuals through food poisoning. This dangerous condition can frequently incur in a hot kitchen environment.

SUMMARY OF THE INVENTION

It is the objective of this invention to provide a safe pan cooling device and method employing a uniquely configured cooling element located in close proximity to the pans and mounted so that substantially the entire cooling element is disposed within the cooling chamber of the refrigeration unit.

The pan cooler of this invention comes in two main embodiments: Each has several special features, no single one of which is solely responsible for its desirable attributes. Without limiting the scope of this invention as expressed by the claims which follow, its more prominent features will now be discussed briefly. After considering this discussion, and particularly after reading the section of this application entitled, "DETAILED DESCRIPTION OF THE PREFERRED EMBODIMENTS," one will understand how the features of this invention provide its advantages, which include its ease of installation and repair, lower maintenance, greater efficiency in cooling, elimination of unneeded blowers, and safety associated with adequate cooling of the food in the pans stored in a refrigeration unit.

First Embodiment

The first of the first embodiment of the invention is that it may be built into refrigeration units upon being manufactured as original equipment or may be retrofitted on existing equipment. The original equipment refrigeration unit would be designed for use with a plurality of open pans which hold food and are removably mounted in the top wall of the cabinet of the unit. There would be an opening or opening in the top wall that enables the pans to be seated in the opening. The retrofit pan cooler includes a bracket which is attached to the top wall of the existing refrigeration unit. This bracket carries the two main components of the invention: location means and cooling elements.

The location means provide seating an individual pan in one of a plurality of predetermined pan positions in the opening. An individual pan when in a predetermined pan position is seated in the opening so that substantially the entire pan is disposed within the cabinet member's cooling chamber. The location means allows an individual pan to be removed from the opening and then reseated in the opening. The pan may be reseated in the same or a different pan position. Preferably, the predetermined pan positions are in a row side by side.

A plurality of cooling elements are provided. They are disposed at the opening, with individual cooling elements being located between, and in close proximity to, the pan positions and being mounted so that substantially the entire cooling element is disposed within the cabinet member. Advantageously, the cooling elements are of a panel-type configuration comprising a planar housing enclosing tubing which carries a refrigerant that is circulated from a remote compressor through the tubing. The panel-type cooling element has thickness of from about 0.5 to about 1 inch, a length of from about 6 to about 24 inches, and a height of from about 3 to about 12 inches. The tubing has an input end and an output end, each of which extend outward from the housing and may be easily attached and detached to means for circulating refrigerant from the compressor. A cooling elements with fins may also be employed. Preferably, there is a gutter member in the cabinet near the cooling elements that collect moisture from the cooling elements upon defrosting. For best results, each cooling element is immediately adjacent a pan placed in one of the predetermined pan positions and there is essentially no structure between the pan and the cooling element that would significantly interfere with effective cooling of the pan. In some instances it is desirable that the cooling elements have a configuration which is complementary to the configuration of the pans so that the pans nest within the cooling elements upon being placed in the opening.

Second Embodiment

The first feature of the second embodiment of the invention is that it employs an enclosure which has walls that enclose the predetermined pan positions except for the opening to allow pans to be removed and reseated in the opening. The enclosure surrounds the opening in the top of the refrigeration unit and the location means establishing the predetermined pan positions. This enclosure provides a confined space adjacent pans placed in the opening to enable cool air to be circulated within the enclosure past pans seated in the pan positions. For example, the enclosure may be a box-like structure with an open top, the confined space is near the lower portion of box-like structure, and the predetermined pan positions are immediately above said confined space. The distance between the bottom of the enclosure and the bottom of pans seated in the opening exceeds about 1 inches, and preferably ranges between about 1 and about 3.5 inches.

The second feature of this second embodiment is a cooling element disposed within the walls of the enclosure so that the cooling element is in close proximity to the pan positions. The walls with the cooling element are positioned so that substantially the entire cooling element is disposed within the cabinet member.

The third feature of this second embodiment is that there are means for circulating air through the confined space. Preferably, the means for circulating air through the confined space is a fan mounted within the enclosure.

The Method

This invention also encompasses a method of cooling a plurality of pans holding food in a commercial refrigeration unit: This method comprises (a) placing the pans in the opening in the top of the refrigeration unit, seating the pans in location means providing a plurality of predetermined pan positions in the opening, an individual pan when in a predetermined pan position being seated in the opening so that substantially the entire pan is disposed within the refrigeration unit, the location means allowing an individual pan to be removed from the opening and then reseated in the opening, and (b) cooling the pans with a plurality of cooling elements disposed at the opening, with individual cooling elements being located between, and in close proximity to, the pan positions and being mounted so that substantially the entire cooling element is disposed within the refrigeration unit.

BRIEF DESCRIPTION OF THE DRAWING

The preferred embodiments of this invention, illustrating all its features, will now be discussed in detail. These embodiments depict the novel and non-obvious pan cooler and method of this invention, which is shown in the accompanying drawing that is for illustrative purposes only. This drawing includes the following Figures, with like numerals indicating like parts.

DETAILED DESCRIPTION OF THE PREFERRED EMBODIMENTS

Conventional Unit

Figure 1A:
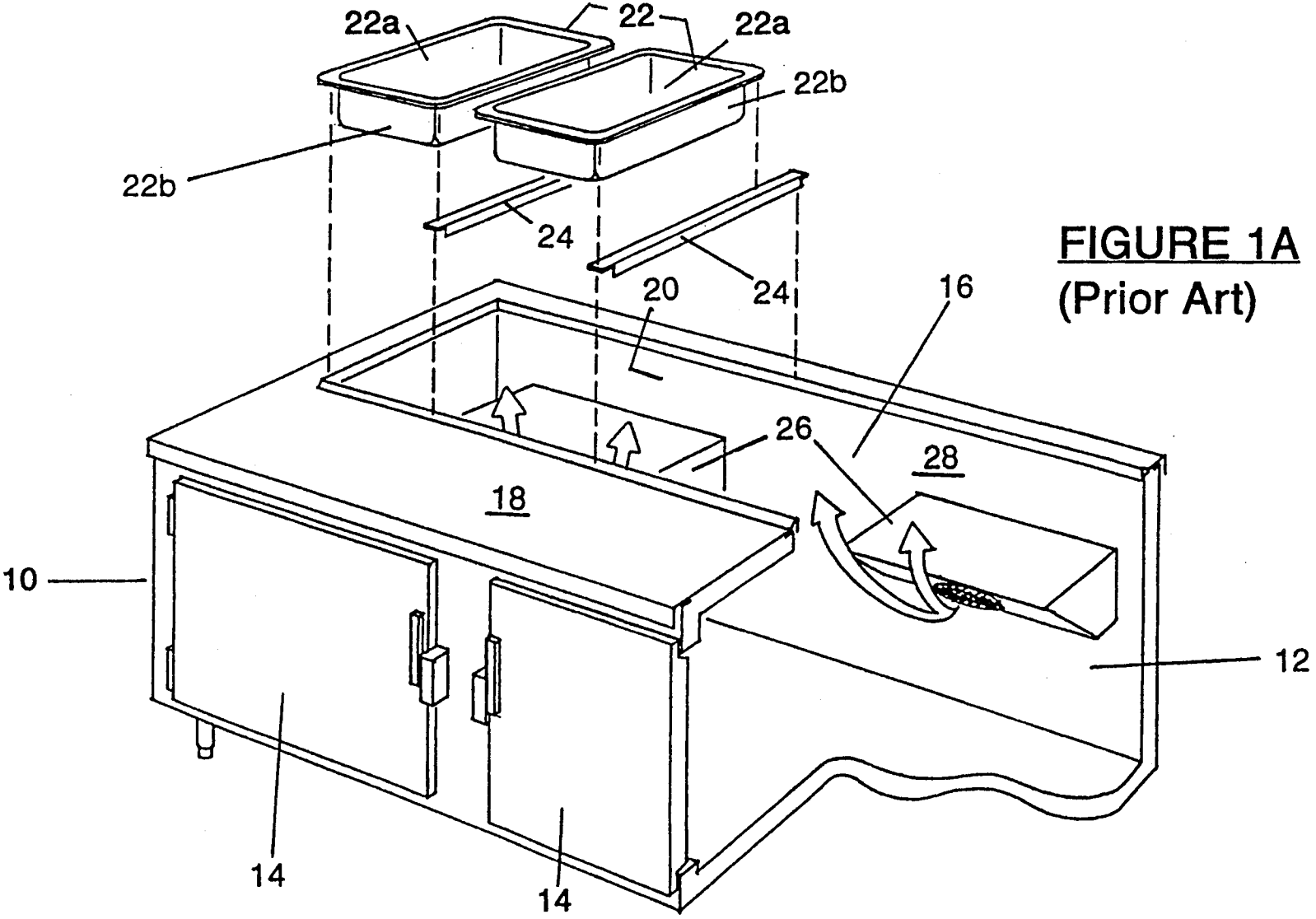
FIGURE 1A (Prior Art)
FIG. 1A is a perspective view of one type of conventional refrigeration unit having a top wall which holds food pans.

FIG. 1A depicts one type of conventional refrigeration unit 10. The conventional unit 10 includes an insulated cabinet 12, typically having one or more front doors 14 that, when opened, provide access to a cooling chamber 16 within the unit. The top wall 18 of the refrigeration unit 10 is generally flat and horizontal, and has therein an elongated, rectangular opening 20 which allows open top, food holding pans 22 to be placed in the refrigeration unit 10 so that the open top **22*a* of the pan is essentially flush with the top wall 18 and the lower body 22*b* of the pan 22 is in the cooling chamber 16. Support bars 24 may be used to separate and hold individual pans 22 in the desired side-by-side pan positions. There is a pair of forced air evaporators 26 mounted to a side wall 28 of the refrigeration unit 10 which includes a blower (not shown) that blows cool air past copper coils (not shown) connected to a remote compressor (not shown). A refrigerant such as Freon is circulated between the evaporators 26 and the compressor. The compressor compresses the Freon coming from the evaporators 26 to change its state to liquid and returns it to the evaporators in the liquid state where it evaporates to cool the air within the cooling chamber 16. The blower forces the air past the cooling coil and upwards against the bottoms and sides of the pans 22 seated in the opening 20. The problem with this conventional refrigeration unit 10 is that the portion of the food in the pan that is centrally located is not adequately cooled in many situations. For example, the evaporators 26 typically circulate cool air at a temperature of about 35–40° F., and the food in the pans 22 is exposed to a room temperature of about 75°–90° F. Such a great difference in temperature between the air in the cooling chamber 16** and the food in the pan, results in a food temperature of about 50°–55° F. which is warmer than acceptable to local Health Departments.

Figure 1B:
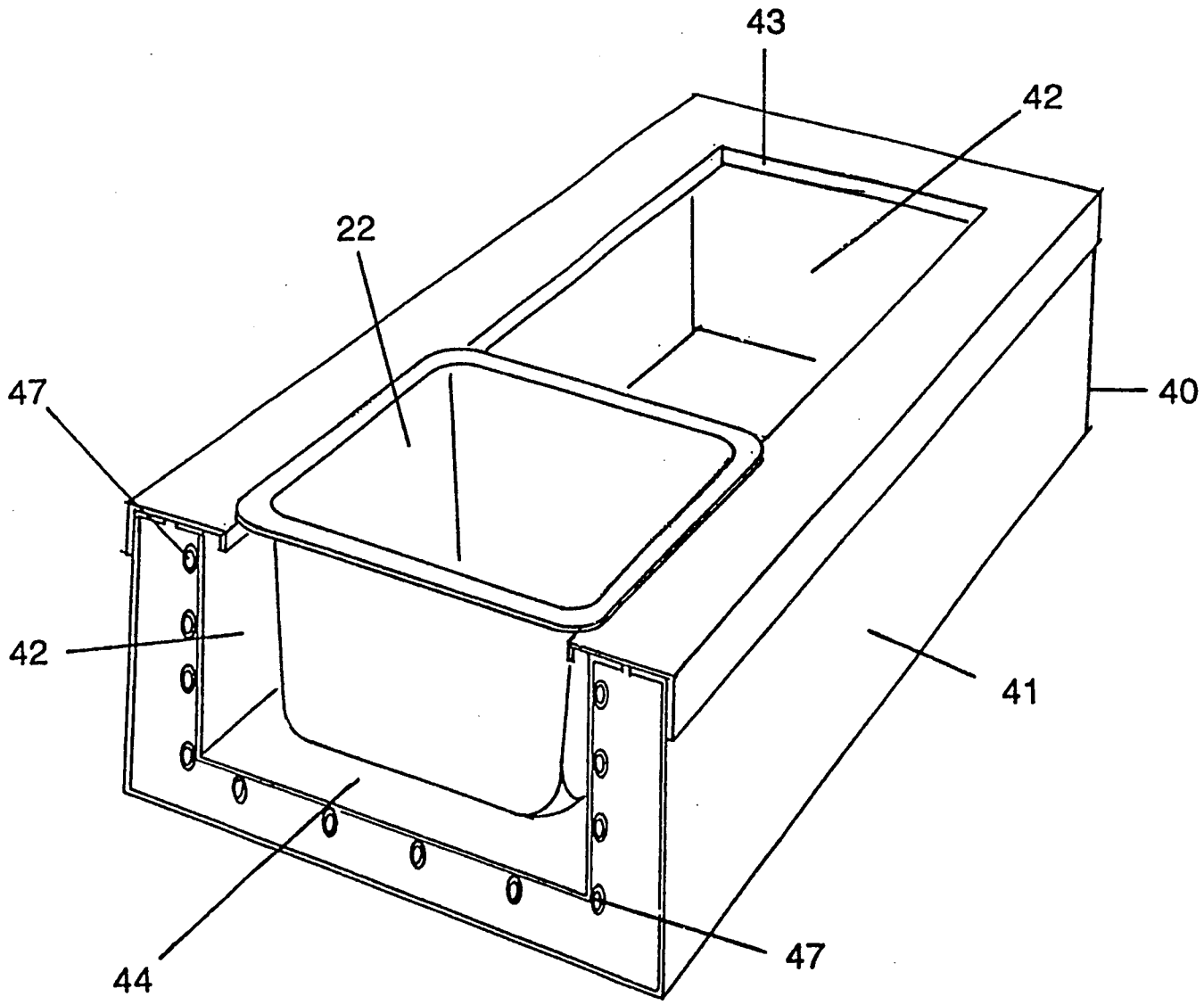
FIGURE 1B (Prior art)
FIG. 1B is a perspective view of another type of conventional refrigeration unit having a top wall which holds food pans.

As depicted in FIG. 1B, another conventional type of refrigeration unit 40 may be used employing an enclosure 41 which has an open top 43 which receives the pans 22, and walls 42, including a bottom wall 44. The walls 42 and bottom wall 44 define a limited space corresponding in volume to essentially the same volume the pans occupy upon being seated in the enclosure. The walls 42 and 44 include cooling tubes carrying refrigerant that is circulated to a compressor (not shown). The distance between the bottom wall 44 and the bottom of a pan 22 seated in the enclosure is less than 0.5 inch. The limited space between the pans seated in the enclosure and the cold walls 42 and 44 restricts circulation of cool air within the enclosure, and the food in the pans 22 does not adequately cool.

The present invention overcomes this problem of inadequate cooling of the food in the pans 22 when stored in the conventional units 10 and 40.

First Embodiment

Figure 2:
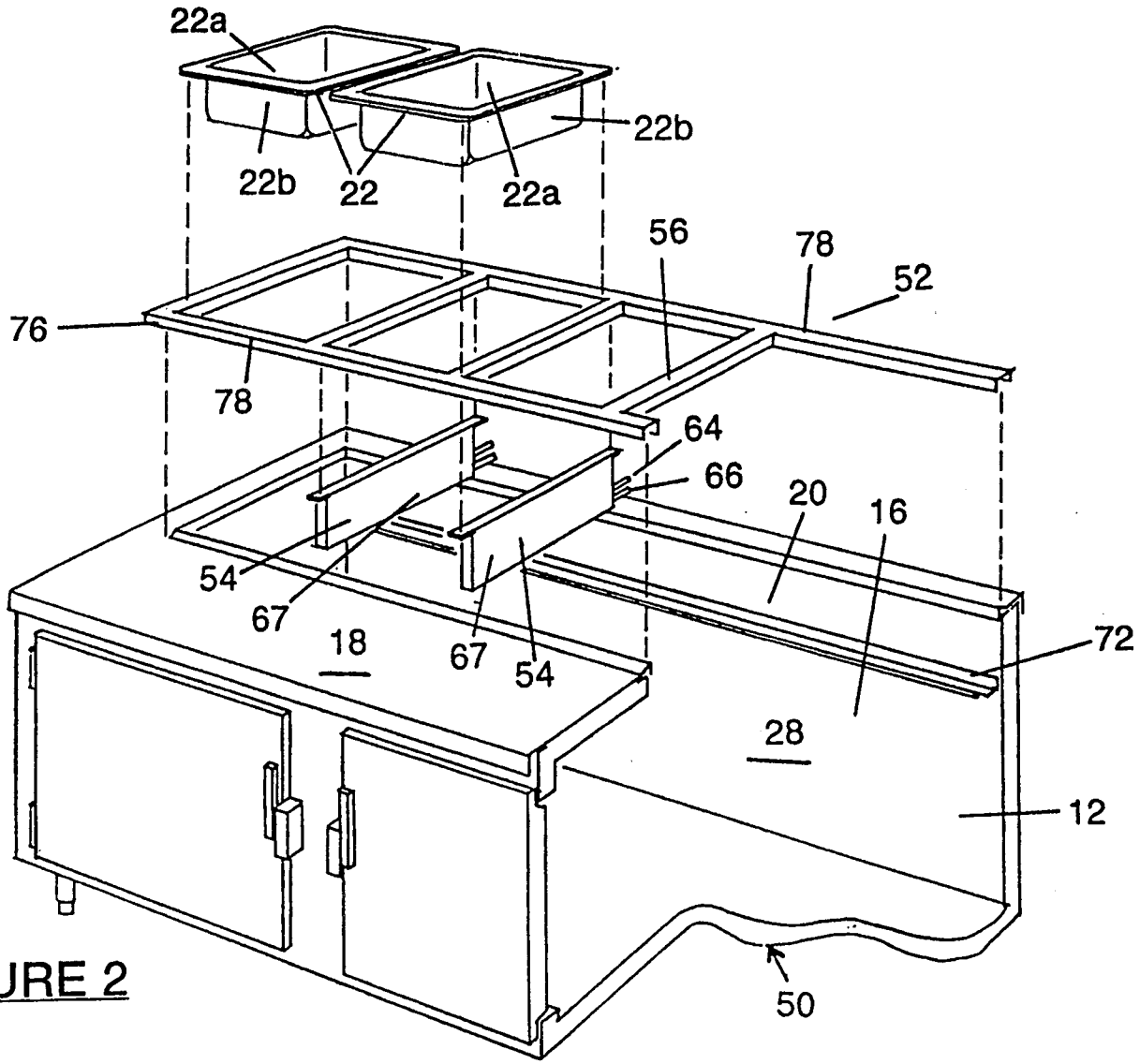
FIG. 2 is an exploded perspective view of a of novel refrigeration unit of this invention using cooling elements in close proximity to the food pans.
Figures 3, 4, 5:
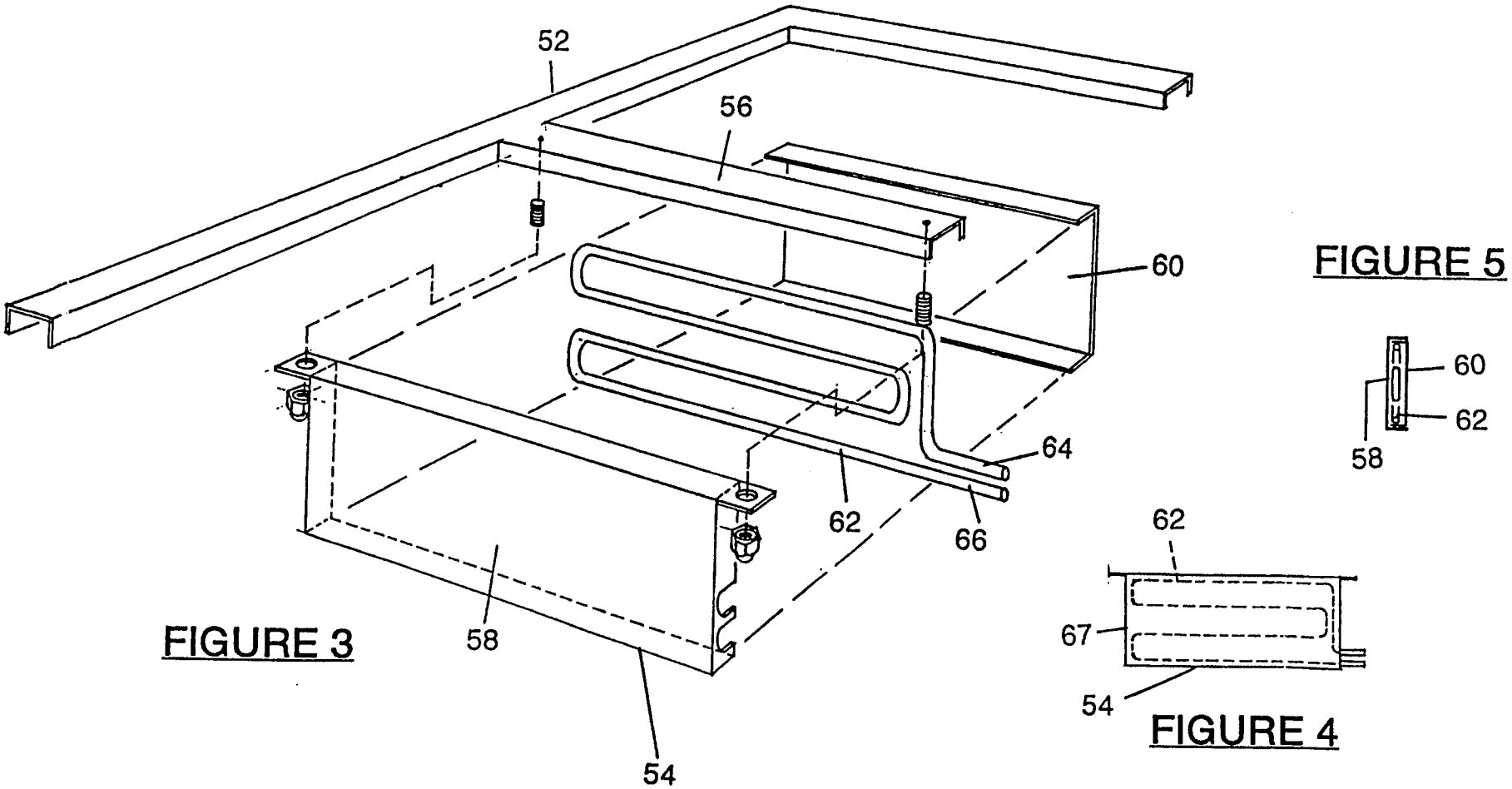
FIG. 3 is an exploded perspective view of a the mounting structure for the cooling elements shown in FIG. 2.
FIG. 4 is a side elevational view of a cooling element used in this invention.
FIG. 5 is an end elevational view of taken along line 5—5 of FIG. 4.

The first embodiment of this invention is depicted in FIGS. 2 through 6. As shown in FIG. 2, the refrigeration unit 50 of this invention includes the cabinet 12 with an opening 20 substantially identical to that of the conventional unit 10. In fact, as will be explained in greater detail subsequently, it is one of the advantages of this invention to enable the conventional refrigeration unit 10 to be retrofitted with a unique retrofit device 52 (FIG. 2 and 3) that provides proper pan cooling.

Figure 6:
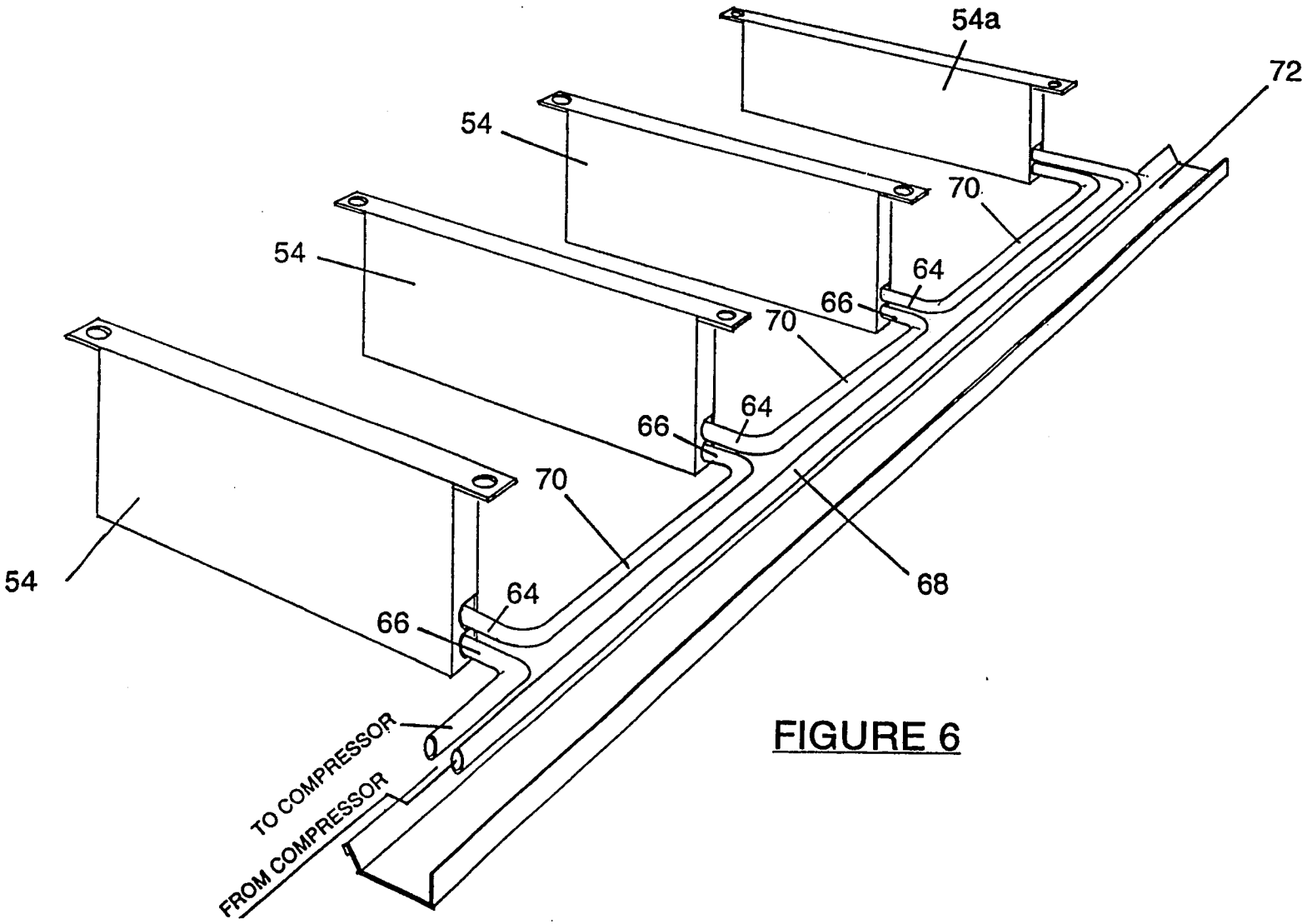
FIG. 6 is a perspective view of showing the manner in which the cooling elements are attached to piping which circulates coolant through the cooling elements.

In most instances, either one or both of the forced air evaporators 26 can be eliminated. Cooling, instead, is provided by a series of panel-type evaporators 54 depicted best in FIGS. 3 through 5. There is a removable or stationary pan mounting bars 56 disposed in the opening 20. These bars 56 are spaced apart to define predetermined pan positions in the opening 20 to enable the pans 22 to be located precisely. Attached to each bar 56 are a pair of metal, for example, stainless steel wall structures 58 and 60 that are bolted together form a housing 67 which encloses a circuitous copper tubing 62 having an input end 64 and an output end 66 which extend outwardly from the housing. As shown in FIG. 6, the panel-type evaporators 54 are connected in series, with the end 64 of the first evaporator **54*a* being attached to primary pipe 68 that carries refrigerant from a remote compressor to the tubing 62 (FIGS. 3–5) in the evaporator 54*a*. There are secondary pipes 70 connecting the output ends 66 of adjacent panel-type evaporators 54 to the input ends 64 of the next in series evaporator. It is conventional practice to solder the ends of the tubing 62 to the pipes 68 and 70. The term used by plumbers is "sweating" and "desweating," and this is easily accomplished using conventional techniques. Thus, if there is a defect or break in the tubing 62, the panel-type evaporator 54** carrying the broken tubing can be easily removed and replaced.

In accordance with this invention, the panel-type evaporators 54 are individual cooling elements disposed at the opening 20 and are located between, and in close proximity, to the pan positions, and are mounted so that substantially the entire housing 67 or cooling element is disposed within the cooling chamber 16 in the cabinet 12. Each housing 67 is immediately adjacent a pan placed in one of the predetermined pan positions without essentially any structure that would significantly interfere with effective cooling of the pan being between the pan and the housing 67. Because of this close relationship between the cooling element and the sides of the pan, the food in the pans 22 is maintained relatively cool.

As shown in FIG. 2, a gutter 72 is mounted to the side wall 28 of the refrigeration unit 50 adjacent the lower portion of the housing 67. Thus, upon defrosting, moisture collected on the housing 67 will drip into the gutter 72 and be carried away.

The panel-type evaporators 54 may be individually attached to support bars 24 already in place in the conventional unit 10, or the retrofit device 52 of this invention may be used to retrofit the conventional refrigeration unit 10. As best depicted in FIG. 2, the retrofit device 52 includes a bracket 76. This bracket 76 has side rails 78 and the bars 56 are cross rails connected between the side rails 78. This configuration of side rails 78 and bars 56 define pre-determined pan positions. The bars 56 allow the housings 67 to be attached removably so that the panel-type evaporators 54 can be easily attached or detached as discussed above. The retrofit device 52, including the bracket 76, pipes 68 and 70, and attached panel-type evaporators 54, is designed to fit into the opening 20 in the top wall 18 of the conventional unit 10. This retrofit device 52 is simply dropped into the opening 20, and the pipes 68 and 70 are connected to the remote compressor (not shown). The bracket 76 is substantially coextensive with the perimeter of the opening 20.

Figure 7:
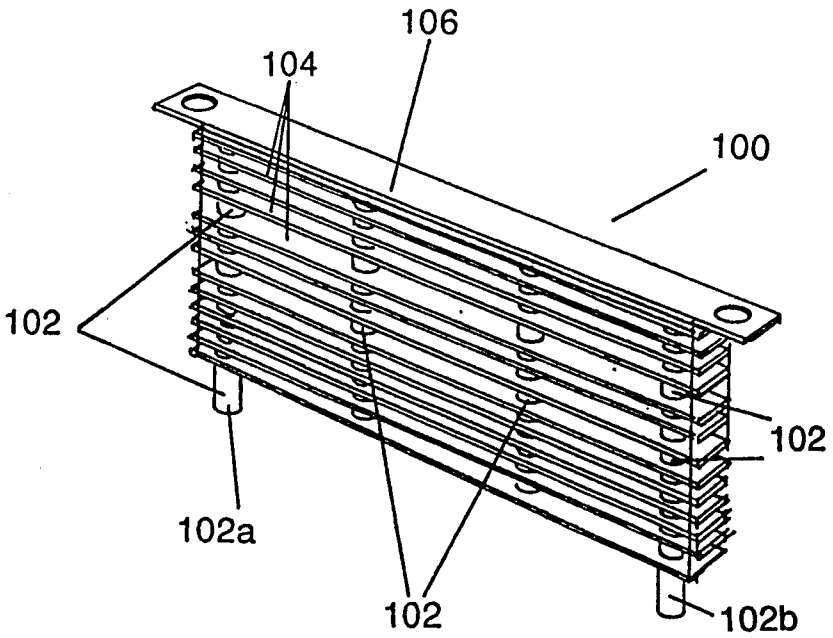
FIG. 7 is a perspective view of an embodiment of this invention which uses a cooling element with fins that dissipate heat.

FIG. 7 depicts a cooling element using tubing 102 with fins 104 attached to the tubing by force fitting techniques. The tubing extends from an input end **102*a* and follows a sinusodial like path first upward towards a mounting plate 106, and then parallel with the plate, then downward and back and forth again, terminating at the output end 102*b*. The fins 104 dissipate heat. This type of structure may be used instead of the panel-type evaporators 54**.

Figure 8:
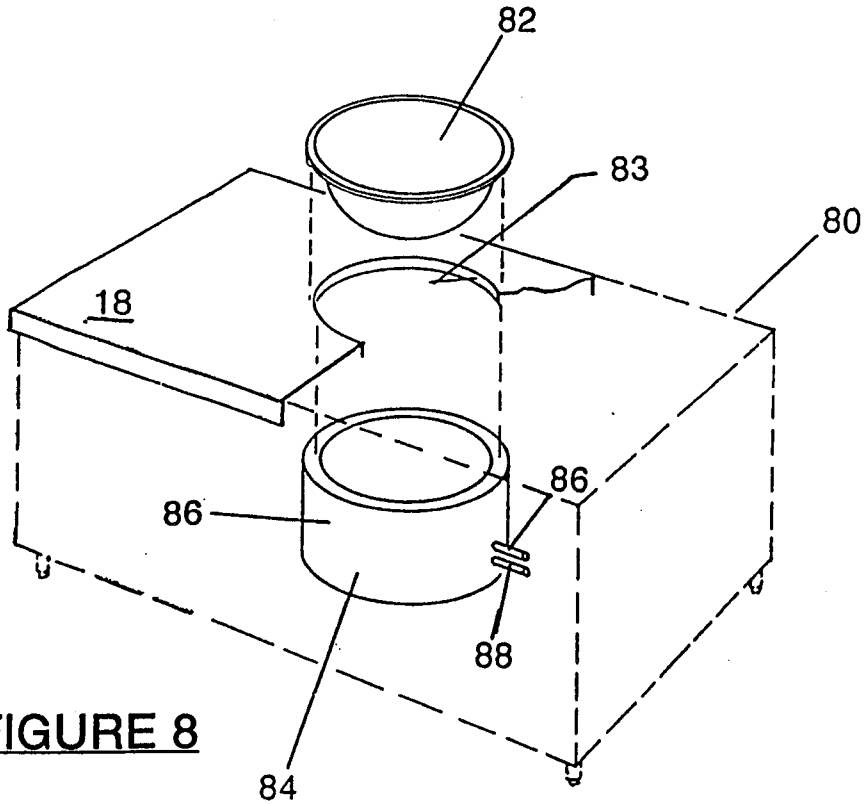
FIG. 8 is a perspective view of an embodiment of this invention which is used with bowl-like of cylindrical food pans.

FIG. 8 depicts a cooling device 80 to be used with pans 82 having a generally bowl-like or cylindrical configuration. Here, the cooling element 84 is in the form of a hollow cylinder which is complementary to the configuration of the pan 82. The wall 86 of the cylindrical cooling element 84 is hollow and includes tubing (not shown) through which refrigerant is circulated. The input and output ends 86 and 88, respectively, of the tubing are connected to a remote compressor (not shown). When the pan 82 is dropped into a circular opening 83 in the top wall 18, the cooling element 84 surrounds the side wall of the pan. The bottom of the cylindrical cooling element 84 may be opened or closed.

Second Embodiment

Figures 9, 10:
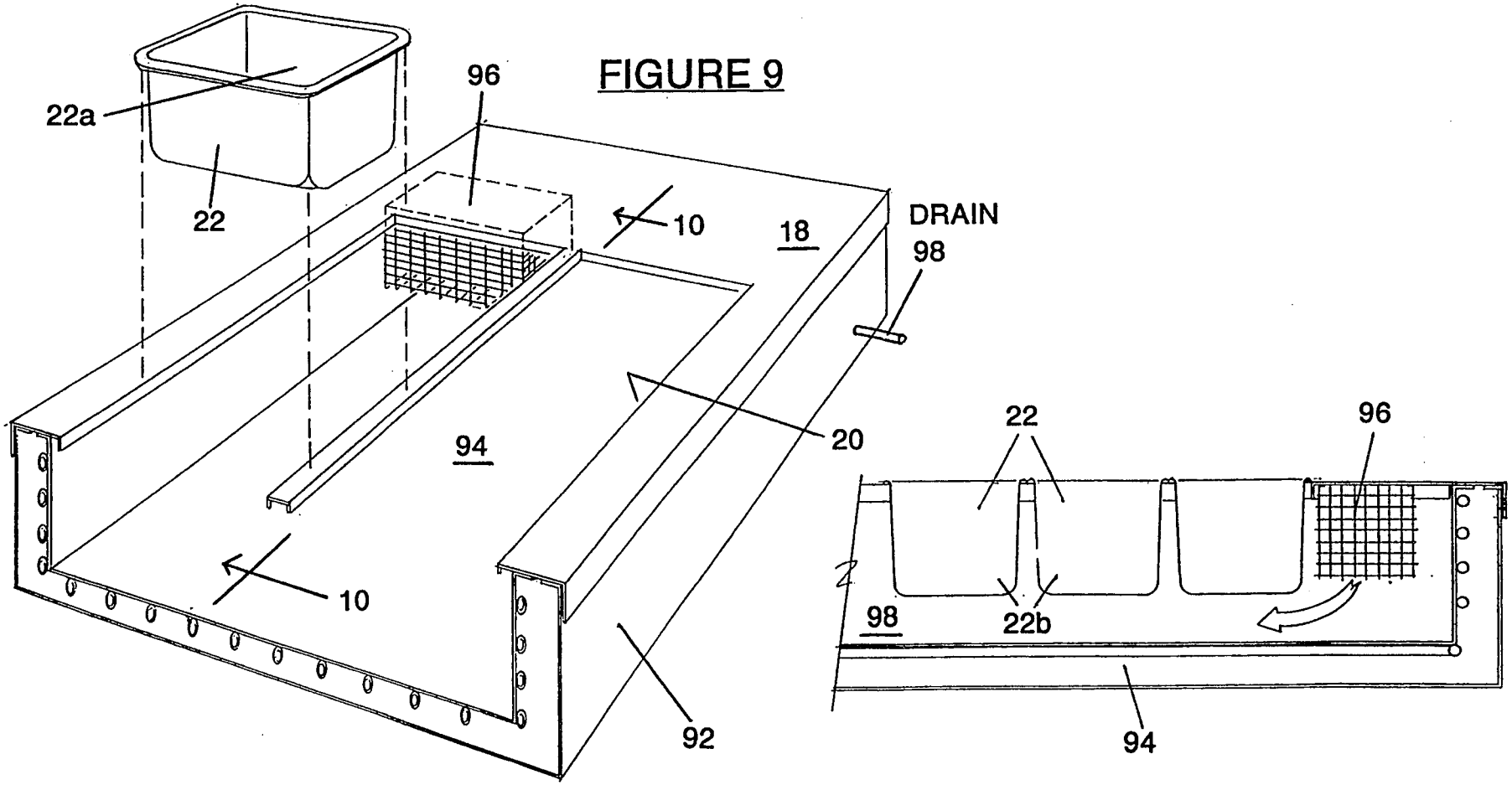
FIG. 9 is a perspective view of an alternate embodiment of this invention which uses an enclosure that provides a confined space adjacent food pans and in which cool air is circulated past the pans.
FIG. 10 is a cross-sectional view taken along line 10—10 of FIG. 9.

As illustrated in FIGS.9 and 10, the second embodiment of this invention is shown where the opening 20 in the top wall 18 of a refrigeration unit (not shown) has an adjacent enclosure 92 beneath it. The enclosure 92 differs in two major respects from the conventional unit 40 shown in FIG. 1B: it is larger with its bottom wall 94 being spaced a substantial distance from the bottoms of pans 22 seated in the opening 20, and it includes a fan 96 which circulates cool air within the enclosure 92. The distance between the bottom wall 94 and bottom of the pans typically is between about 1 and about 2 inches. The enclosure 92, like the conventional unit 40, does not cover the opening 20 so that pans 22 may be inserted into this opening and seated within the enclosure 92 so that essentially the entire lower body of each pan is disposed within the enclosure. The enclosure 92 segregates the pans 22 from the cooling chamber 16, but the enclosure is surrounded by the air in the cooling chamber, except for its open top that receives the pans. The exterior walls of the enclosure 92, like unit 40, have housed within them cooling coils which are connected, as discussed above, to a remote compressor. In accordance with this invention, there is a confined space 98 within the enclosure 92 immediately beneath the pans 22 which allows cool air to be circulated by the fan 96 past the cold walls of the enclosure and underneath the bottoms of tile pans and sides of the pans. There is a drain 98 in the enclosure 92 that allows condensed water to flow from the enclosure during defrosting.

SCOPE OF THE INVENTION

The above presents a description of tile best mode contemplated of carrying out tile present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not tile intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

We claim:

1. A refrigeration unit adapted to removably mount in the refrigeration unit a plurality of pans which hold food, including a cabinet member having a top wall with an opening therein that enables the pans to be seated in the opening, location means for seating an individual pan in one of a plurality of predetermined pan positions in the opening, the predetermined pan positions being in a row side by side, an individual pan when in a predetermined pan position being seated in the opening so that substantially the entire pan is positioned within the cabinet member, said location means allowing an individual pan to be removed from the opening and then reseated in the opening, a plurality of cooling elements positioned at the opening, individual cooling elements being located between, and in close proximity to adjacent pan positions, and being mounted so that each cooling element is positioned substantially within the cabinet member and lies across the row of pan positions.

2. The refrigeration unit of claim 1 where the cooling elements include at least one which has tubing with fins that dissipate heat.

3. The refrigeration unit of claim 1 where the cooling elements include at least one which has a panel-type configuration comprising a planar housing enclosing tubing which carries a refrigerant that is circulated from a remote compressor through said tubing.

4. The refrigeration unit of claim 3 where the tubing has an input end and an output end, each of which extend outward from the housing and may be easily attached and detached to means for circulating refrigerant from the compressor.

5. The refrigeration unit of claim 1 where each cooling element is immediately adjacent a pan placed in one of the predetermined pan positions and there is essentially no structure between the pan and the cooling element that would significantly interfere with effective cooling of the pan.

6. The refrigeration unit of claim 5 where at least one cooling element has a configuration which is complementary to the configuration of a pan so that said pan nests within the cooling element upon being placed in the opening.

7. A refrigeration unit adapted to receive a plurality of pans removably mounted in the refrigeration unit, including a cabinet member having a top wall with an opening therein that enables the pans to be seated in the opening, a location member for seating an individual pan in one of a plurality of predetermined pan positions in the opening, the predetermined pan positions being in a row side by side and closely spaced apart, with an individual pan when in a predetermined pan position being seated in the opening so that substantially the entire pan is positioned within the cabinet member, said location member allowing an individual pan to be removed from the opening and then reseated in the opening in a selected one of said pan positions, and a plurality of cooling elements positioned at the opening, individual cooling elements being between adjacent pan positions and having a generally planar configuration and being mounted so that substantially the entire cooling element is positioned within the cabinet member and lies across the row of pan positions, each cooling element being immediately adjacent a pan placed in one of the predetermined pan positions in close proximity to adjacent pan positions, there being essentially no structure between the pan and the cooling element that would significantly interfere with effective cooling of the pan.

8. The refrigeration unit of claim 7 where the cooling elements include at least one which has tubing with fins that dissipate heat.

9. The refrigeration unit of claim 7 where the cooling elements include at least one which has a panel-type configuration comprising a housing enclosing tubing which carries a refrigerant that is circulated from a remote compressor through said tubing.

10. The refrigeration unit of claim 9 where the tubing has an input end and an output end, each of which extend outward from the housing and may be easily attached and detached to means for circulating refrigerant from the compressor.

11. The refrigeration unit of claim 7 where each cooling element has a thickness of from 0.5 to 1 inch, a length of from 6 to 24 inches, and a height of from 3 to 12 inches.

12. The refrigeration unit of claim 7 where each cooling element is adapted to be detached and replaced.

13. The refrigeration unit of claim 7 where the location member is a retrofit device which is attached to the cabinet member at said opening.

14. A refrigeration unit adapted to receive a plurality of pans which hold food removably mounted in the refrigeration unit, including a compressor that circulates a refrigerant, a cabinet member having a top wall with an opening therein that enables the pans to be seated in the opening, a location member in the opening for seating an individual pan in one of a plurality of predetermined pan positions in the opening, the predetermined pan positions being in a row side by side and closely spaced apart a predetermined distance, with an individual pan when in a predetermined pan position being seated in the opening so that substantially the entire pan is positioned within the cabinet member, said location means allowing an individual pan to be removed from the opening and then reseated in the opening in a selected one of said pan positions, a plurality of detachable cooling elements positioned at the opening, individual cooling elements being between adjacent pan positions and having a generally elongated configuration of limited thickness which does not exceed said predetermined distance between pan positions and being of a panel-type configuration comprising a planar housing enclosing tubing which carries the refrigerant that is circulated by the compressor through said tubing, said tubing having an input end and an output end, each of which extend outward from the housing each cooling element being mounted so that substantially the entire cooling element is positioned within the cabinet member and lies across the row of pan positions, each cooling element being immediately adjacent a pan placed in one of the predetermined pan positions in close proximity to adjacent pan positions, there being essentially no structure between the pan and the cooling element that would significantly interfere with effective cooling of the pan, and means for attaching and detaching the tubing from the cooling elements to the compressor.

15. The refrigeration unit of claim 14 where each cooling element has a thickness of from about 0.5 to about 1 inch, a length of from about 6 to about 24 inches, and a height of from about 3 to about 12 inches.

16. The refrigeration unit of claim 15 where the location member is a retrofit device which is attached to the cabinet member at said opening.

17. The refrigeration unit of claim 15 where each cooling element is substantially at a right angle with respect to the row of pan positions.

18. A refrigeration unit adapted to removably mount in the refrigeration unit a plurality of pans which hold food, including a cabinet member having an upper section and a lower section in communication with each other, said upper section including a top wall with an opening therein that enables the pans to be seated in the opening in said upper section, a location member which seats an individual pan in one of a plurality of predetermined pan positions in the opening, an individual pan when in a predetermined pan position being seated in the opening so that substantially the entire pan is positioned within the upper section of the cabinet member, said location member allowing an individual pan to be removed from the opening and then reseated in the opening, and a plurality of cooling element positioned at the opening, with individual cooling elements being located between, and in close proximity to, the pan positions and being mounted so that the entire cooling element is substantially positioned within the upper section of cabinet member.

* * * * *